United States Patent [19]

Maxwell

[11] 4,017,085

[45] Apr. 12, 1977

[54] GOLF GAME

[76] Inventor: Charles Stephen Maxwell, 2995 Altamont Crescent, West Vancouver, British Columbia, Canada, V7V 3C2

[22] Filed: Feb. 27, 1976

[21] Appl. No.: 662,194

[52] U.S. Cl. ..... 273/176 FA; 273/123 A; 273/125 A

[51] Int. Cl.[2] ..... A63B 67/02

[58] Field of Search ..... 273/35 R, 87 R, 176 R, 273/176 FA, 179 R, 179 A, 85 R, 123 A, 125 A; 235/92 GA; 340/323 R

[56] References Cited

UNITED STATES PATENTS

| | | | |
|---|---|---|---|
| 2,470,325 | 5/1949 | Stillman | 273/125 A |
| 3,011,791 | 12/1961 | Page | 273/176 FA X |
| 3,044,778 | 7/1962 | Beck et al. | 273/125 A |
| 3,114,554 | 12/1963 | Hurley | 273/176 FA |
| 3,114,555 | 12/1963 | Hurley | 273/176 FA |
| 3,588,117 | 6/1971 | Hertenstein | 273/176 FA |

FOREIGN PATENTS OR APPLICATIONS

| | | | |
|---|---|---|---|
| 1,061,263 | 3/1967 | United Kingdom | 273/176 FA |

*Primary Examiner*—Richard C. Pinkham
*Assistant Examiner*—Vance Y. Hum
*Attorney, Agent, or Firm*—Townsend and Townsend

[57] ABSTRACT

A golf game is disclosed in which each player uses a standard golf putter for striking a golf ball towards a designated one of three scoring holes provided near one end of a playing surface simulating part of a golf course. Hazard holes which are non-scoring are also provided. Switch contacts are provided in each hole to detect reception of a golf ball. A ball issuing device re-issues the ball when it is detected in one of the holes and the number of balls issued is counted. The designated hole is changed as soon as a player sinks a ball in it or after a predetermined number of balls have been used. A number is assigned to each designated hole and this number is incremented for each player when the player has sunk the ball in the designated hole or when the predetermined number of balls have been used. Scoring is provided for each player which decrements an initial score by predetermined values which vary inversely according to the number of issued balls counted for an assigned hole.

15 Claims, 10 Drawing Figures

ENTER(POR)
F0
COIN?
CO
F5
COIN RESET SELECT
SCORE RESET
SELECT
F1
F1→F0
PLAYER?
C1
F6
F6→F0
INC. SHOOTER
ISSUE BALL
INC. BALL
LOAD STATUS
F2→F6
F2
BALLOUT?
F5→F2
C2
F3
SINK ?
F3→F0
C3
F4
SCORE PULSES
GAME OVER STORE
INC. HOLE
BALLOUT RESET
SINK RESET
F4→F0

178
140
95
95
95
96
99
105
106
98
107
98
100
111
110
112
111
110
113
111
110
110
114
148
F3
117
115

134
133
135
136
137
138
97
101
103
141
104
SP3
SP2
SP1
SCORE LOAD
102
125
123
127
118
127
116
120
119
124
129
128
130

155
156
157
158
150a
CHANNEL SELECTOR
151a
152a
153a
154a
155a
156a
157a
158a
160a
150b
CHANNEL SELECTOR
151b
152b
153b
154b
155b
156b
157b
158b
160b
150c
CHANNEL SELECTOR
151c
152c
153c
154c
155c
156c
157c
158c
160c

150d
CHANNEL SELECTOR
151d
152d
153d
154d
155d
156d
157d
158d
160d
150e
CHANNEL SELECTOR
151e
152e
153e
154e
155e
156e
157e
158e
160e
161e
161d
161c
161b
161a

SCORE UNITS
SCORE TENS
170
BLANK
LT
A
B
C
D
LE
a
b
c
d
e
f
g
DECODER DRIVER
164
14511
166
JAM
PRESET
CLK EN
DECADE BINARY DOWN COUNTER
163
4029
EARLY OUT
CLOCK
U/D
B/D
CARRY IN
165
167
ENTER X
171
SHOOT X
166
SCORE PULSES 186a
186b
186c
185
186
DECADE DECODER
181
177
176
174
HOLE COUNTER
173
7 SEGMENT DECODER DRAWER
182
179
180
175

GOLF GAME

FIELD OF THE INVENTION

This invention relates to a golf game in which a ball may be directed towards one or more holes and a count of the number of strokes taken to sink the ball is kept.

DESCRIPTION OF PRIOR ART

Golf games of this type in which a golf ball and a standard golf putter are used have been proposed but these have been very basic devices and have not included, for example, automatic scoring means. The operation of such games approximates only very roughly the real game of golf particularly in regard to the degree of skill required, the variety of holes offered and the final score achieved at completion of the game.

Accordingly, there is a demand for a golf game which is more realistic and, consequently, more sophisticated and it is an object of the present invention to provide such a game.

In its broadest form, the present invention is directed to a golf game comprising a playing board, an upper surface of the playing board simulating part of a golf course and having a scoring hole therein proximate an end of the playing board and at least one non-scoring hole therein representing a hazard, a golf ball issuing device, switch means associated with each hole to detect capture therein of a golf ball, a scoreboard, logic circuit means including means causing operation of the golf ball issuing device to re-issue a golf ball on detection of a golf ball by one of the switch means, ball count means counting the balls issued, means assigning a number to the scoring hole and incrementing the assigned number on detection of a ball in the scoring hole, and score means decrementing an initial score by predetermined values which vary inversely according to the number of issued balls counted for an assigned hole.

The decrementing score means is particularly valuable as it makes it very easy to arrange the scoring such that a final score of around 72 may be achieved using average golfing ability thus fostering the illusion of a real golf game.

In a preferred embodiment three scoring holes are provided and for every assigned hole number and player a particular scoring hole is designated as the one to shoot for thus enhancing the variety in the game.

BRIEF DESCRIPTION OF THE DRAWINGS

Further features and advantages of the invention will be better understood from the following detailed description when taken in conjunction with the accompanying drawings.

FIG. 9 is a schematic representation of the components of an individual score module of FIG. 4;

DESCRIPTION OF THE PREFERRED EMBODIMENT

Figure 1:
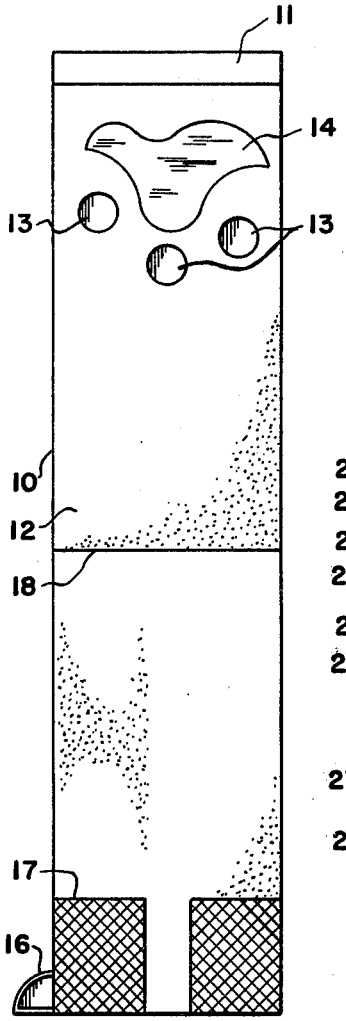
FIG. 1 is a diagrammatic plan view of the playing surface of a golf game according to the invention.
Figure 2:
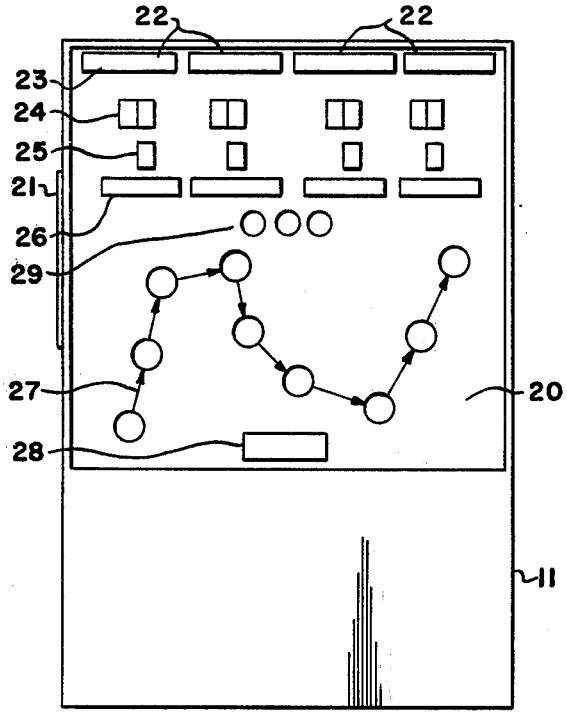
FIG. 2 is a front view of a display and electronics enclosure mounted adjacent the playing surface.

With reference firstly to FIGS. 1 and 2, the golf game comprises a horizontal playing board 10 which is 16 feet by 4 feet by several inches deep, and a display and electronics enclosure 11 mounted vertically at one end of the playing board 10.

The playing board 10 has an artificial turf upper surface 12 near one end of which are three scoring holes 13 representing golf holes and one or more non-scoring holes 14 representing hazards such as a lake or sand traps. A ball return guide (not shown) is located under the playing surface 12 and serves to guide a golf ball which has dropped through any of the holes 13 or 14 to the other end of the playing board 10 where a ball issuing device (not shown) is located. The ball issuing device may be selected from those currently available in the pin ball machine industry. It is solenoid operated and serves, when commanded, to issue a ball into a ball tray 16 mounted on the board 10. Proximate the ball tray 16 is a rubber mat 17 on the playing surface 12.

A numbered flag (not shown) which can be illuminated is mounted at the rear end of each hole 13 and a microswitch (not shown) is disposed in each hole 13 for operation by a ball being received in the respective hole 13. A further microswitch (not shown) common to all the non-scoring holes 14 is mounted at an appropriate part of the ball return guide for actuation by a ball being received in any non-scoring hole 14.

The playing surface 12 slopes upwardly away from both longitudinal ends to a crest 18 midway between the ends. The crest is sufficiently high that a ball when struck from that end at which the mat is located sufficiently hard to pass the crest will not stop short of the other end but will be received in one of the holes 13 or 14.

The display and electronics enclosure 11 is formed as a rectangular cabinet having a display and score board 20 on one surface and which encloses all the logic circuitry. A coin slot 21 provided in the left hand side (as seen in FIG. 2) of the cabinet forms part of a conventional coin acceptance device which accepts coins of the correct denomination and issues a pulse to the logic circuitry. Associated with the coin acceptance device is a coin rejection device which causes rejection of the coin if there are already four players playing. A noise making device is also located in the enclosure 11.

The score board 20 consists of four individual player displays 22 each including: one digit player number indicator 23, two digit score indicator 23, one digit hole indicator 25, and game over indicator 26 as well as the following displays common to all players; golf course layout with nine hole indicators 27, bonus indicator 28, and ball count indicators 29 BALL 1, 2, 3. A noise making device is also incorporated in the enclosure 11.

The logic circuitry is arranged so that the game can be played according to the following rules and sequence.

Prospective players deposit the required coin in the coin acceptor; for each correct amount a player position is assigned up to a maximum of four.

A new player may start any time a space becomes available. If a player tries to start when there are already four players on the display, he shall have his coin rejected.

For each new player, the score is re-set to 100, the hole is re-set to 1, the game over light turned off, the player is added to turn counter, and in the case where the new player is the only player, the ball count is re-set to 1, he is issued a ball and play begins.

A game consists of nine regulation holes and three bonus holes if earned.

Players shall take turns with each player being allowed to continue shooting until he fails to make a hole (except bonus) on the first putt.

The player to shoot is designated by flashing his score digits, the current hole that he is on and the cup marker for the cup he is to shoot at.

If he misses a putt on the designated hole, his score remains unaltered and an "NNG" sound is generated. The ball count is advanced and a new ball is issued.

Should he miss three putts on one hole, his score will remain unaltered, his hole count is incremented and the ball count is re-set to 1. His score stops flashing and the next player is designated to shoot.

If the player sinks the ball in the correct cup a "BONG" sound is generated, his score is decremented by the appropriate amount, his hole count is incremented.

If the putt was made correctly on the first attempt the same player continues, now shooting for the next hole.

If the putt was made correctly on the second or third attempt the next player is called on to shoot.

A player becomes eligible for the bonus if he makes the ninth hole correctly on the first attempt. The bonus consists of three additional holes of play with the player allowed only one putt or attempt per hole. The player will complete the bonus holes to end game whether he makes each hole or not.

If he sinks the ball in the correct bonus hole a "SIREN" sound is generated along with the appropriate score adjustment.

A player's game shall end when: he makes the ninth hole correctly on his second or third putt, or he misses on the ninth hole altogether, or he makes or misses the third bonus hole.

When a player's game is finished his game over sign lights up, his display will freeze at the score that he achieved and his position is deleted from the truns counter.

When all players are finished their displays are similarly frozen at the current hole and score, their game over signs will come on and no more balls are issued, until more coins are deposited for a new game(s).

The electronics shall score the game according to the following formulae:

The electronics shall determine if the ball was sunk in the hole which it has designated. If the ball is correctly sunk the shooting player will have his score decremented according to the following formulae:

| Sunk On: | Holes 1–8 | Hole 9 | Bonus Holes |
|---|---|---|---|
| Ball 1 | 3 | 4 | 1 |
| Ball 2 | 2 | 3 | 2 |
| Ball 3 | 1 | 2 | 3 |

i.e. player starts out with score of 100. If he makes all his holes from 1 through 9 on the first putt and misses all his bonus shots, he will have a score of 72 or PAR . . . Best possible score is 66, that is, all holes are sunk on first putt and all bonus holes are made correctly.

The sequence of play as performed by the logic circuitry is divided into six functions, F0 through F6. The logic circuitry moves through these functions as determined by external conditions as shown by the flowchart FIG. 3.

Function F0 is used solely to detect if any coins have been inserted in the coin acceptor. If no coins have been received the logic circuitry moves into function F1. If coins have been received, function F5 is entered where the next available player position on the display is initialized and the new player is entered into the sequence of whose turn it is to shoot.

Function F1 checks to see if any players are presently entered in the game. If no players are entered in the game, the logic circuitry returns to function F0 to look for coins, i.e. the machine is in the idle state waiting for player entry. If some players have been entered, function F2 is entered.

Function F2 checks to see if a ball has been issued to the playing surface. If a ball has not been issued, function F6 is entered where the player whose turn it is to shoot is determined, a ball is issued to the playing surface with the appropriate ball number display control, and the amount to be scored if this player correctly sinks this putt is determined based on the current status of the player (hole, ball, bonus, etc.). If a ball has already been issued, function F3 is entered.

Function F3 checks to see if the issued ball has returned through one of the holes 13 or 14 in the playing surface as detected by the micro-switches in the holes. If the issued ball has not returned the logic circuitry returns to function F0, i.e.: to check for new players and then return through the various functions to F3 to again look for the issued ball. If the issued ball is returned function F4 is entered.

In function F4 the logic circuitry decides what score adjustment to make, if any, dependent on which hole the ball was sunk and the player status as set up in function F6. In addition, the players hole counter is adjusted, if necessary, and the various gates relating to the fact that the issued ball has returned are re-set. Once these operations are completed the logic circuitry reverts to function F0 and the game proceeds as before.

Figure 4:
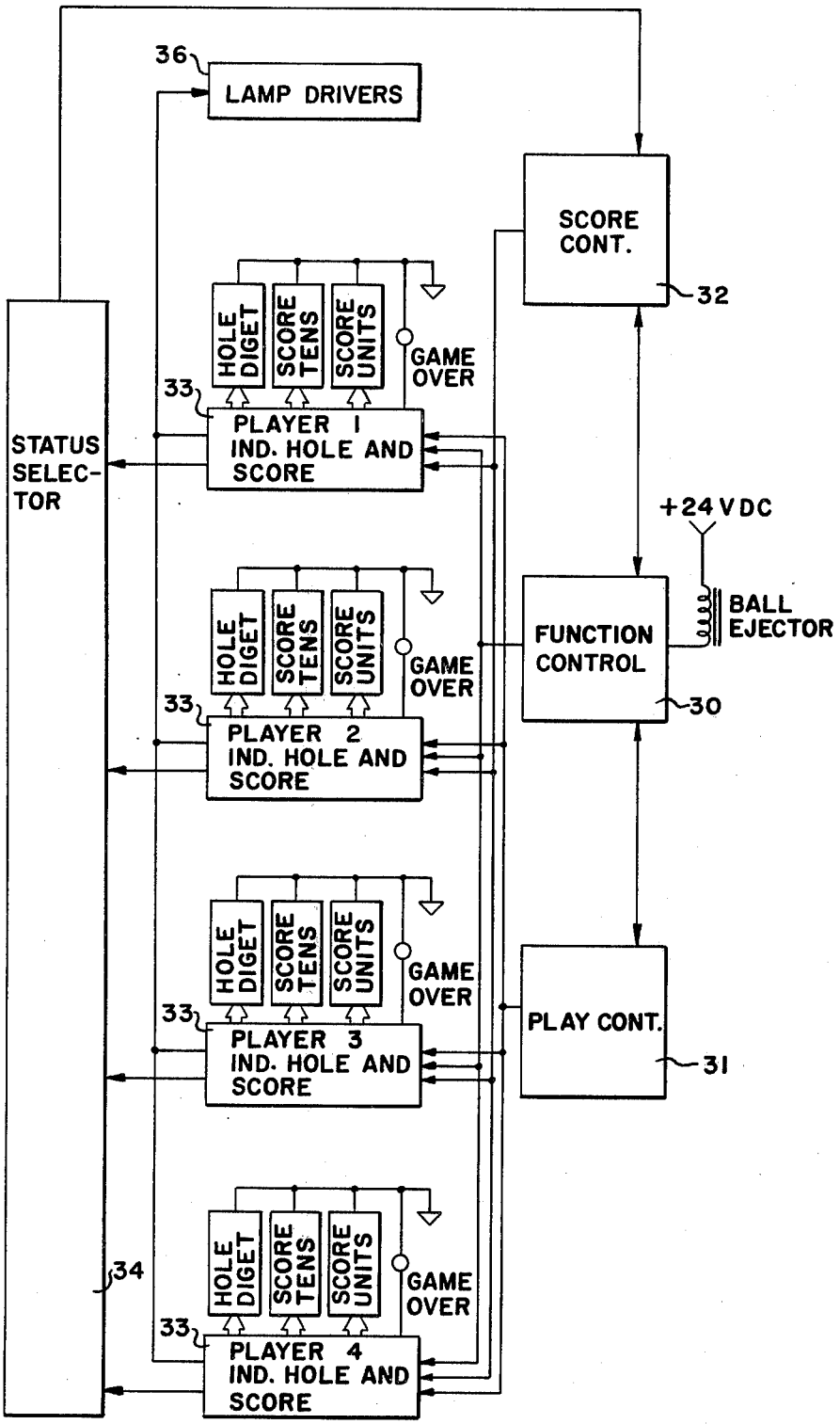
FIG. 4 is a block diagram showing the interconnection of the electronic modules forming the logic circuitry.

FIG. 4 relates the connection of various electronic modules involved in the execution of the above functions. This drawing should be consulted in conjunction with the schematic drawings, FIGS. 5–10, in reading the following discusson discussion the individual modules to retain an overview of the electronic system as a whole.

The logic circuitry of FIG. 4 comprises a FUNCTION CONTROL module 30 which controls the movement between the various function, a PLAY CONTROL module 31 which controls the entry and exit of players as well as determining which player is to shoot at any given time, a SCORE CONTROL module 32 which decodes the score adjustment, monitors the microswitches in the holes 13 and 14, four INDIVIDUAL SCORE AND HOLE modules 33 to keep track of the score and hole status of each player, a STATUS SELECTOR module 34 which selects the player status information required for the determination of scoring as done on the SCORE CONTROL module 35, and a LAMP DRIVER module 36 which powers the nine hole indicators 27.

Figure 5:
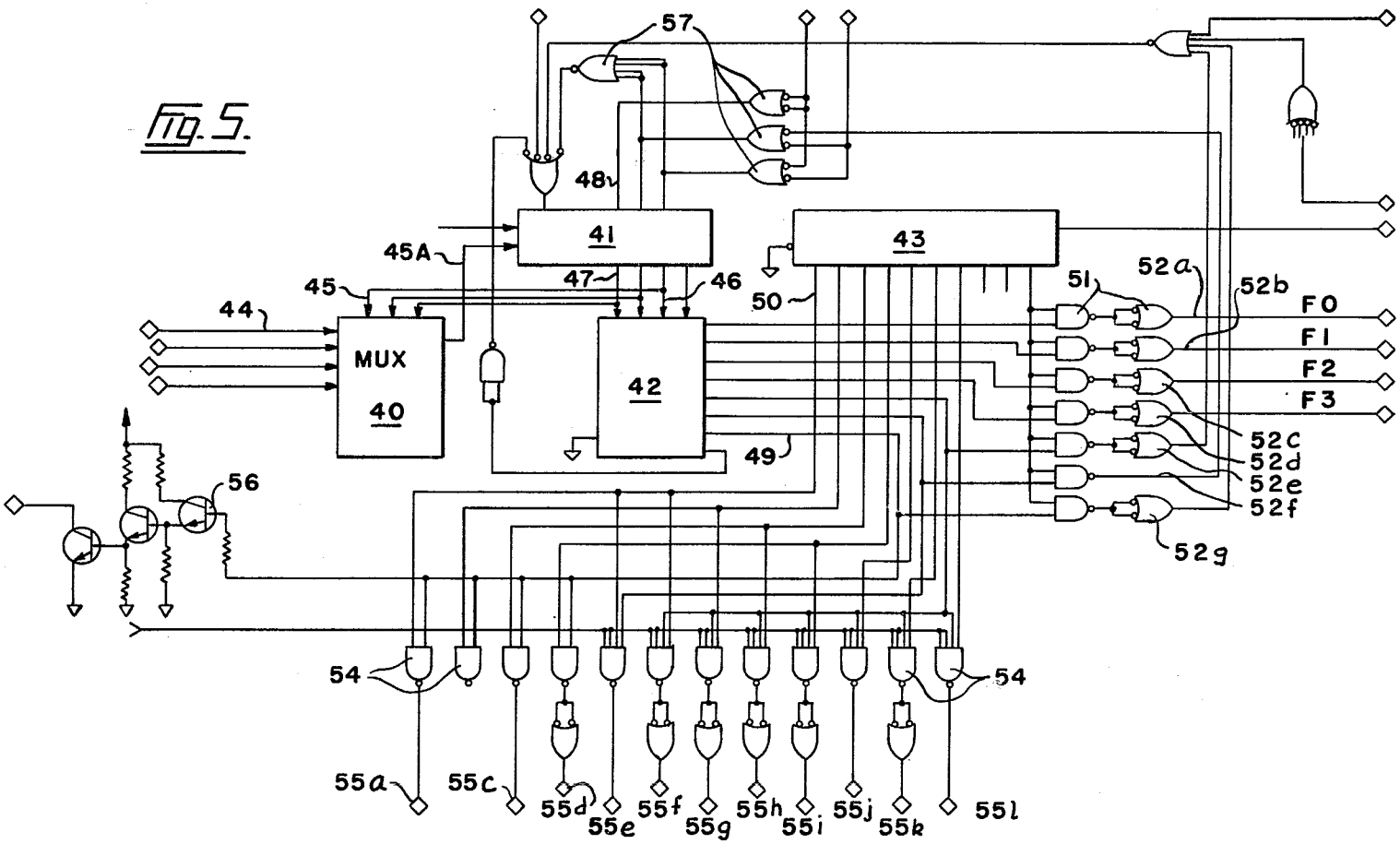
FIG. 5 is a schematic representation of the components of a function control module of FIG. 4.

With reference to FIG. 5, the Function Control Module 30 comprises four main components, namely a Multiplexer 40, a presettable UP/DOWN counter 41, a BCD to Decimal decoder 42, and a Counter Divider 43.

The multiplexer 40 has four signal inputs 44, three binary select inputs 45 connected to outputs 47 of the UP/DOWN counter 41, and a simple output 45A connected to the clock enable of the UP/DOWN counter 41. Outputs 47 of UP/DOWN counter 41 are the binary function code of the logic determined sequentially as clocked when enabled by output 45A of multiplexer 40, or as preset through the jam inputs 48. This binary function code is decoded by decoder 42 into one of seven outputs 49 which are gated with outputs 50 of the Counter Divider 43 to provide control signals during the functions described above.

The counter divider 43 provides sequential pulses at its outputs 50 which are ten times shorter than the pulses derived on outputs 49. The extreme right hand output 50 is gated with all the outputs 49 by means of gates 51 which derive outputs in the form of short pulses at the output terminals 52 which pulses correspond from top to bottom to functions F0, F1, F2, F3, F4 → F0, F5 → F2 and F6 → F0.

Gates 54 which are also activated by selected outputs 49 and outputs 50 derive pulses at outputs 55 the purpose of which will be described below.

Looking from left to right on FIG. 5, terminal 55*a*, provides an 'increment shooter' or 'INC SHOOTER' pulse, 55*b* in a spare, 55*c* provided an 'INC BALL' pulse and 55*d a* 'SCORE LOAD' pulse all during function F6. Terminal 55*e* provides a 'COIN RESET' pulse during function F6. Terminal 55*f, g, h,* and *i* derive score pulses SP1-4 during function F4, terminal 55*j* derives 'END' strobe, 55*r* derives 'INC HOLE' pulses and 55*l* derives 'RESET' pulses for the ball out and sink latches also during F4.

One of the outputs 49 is directly connected to a Darlington drive circuit 56 for powering the ball issuing device.

The inputs 48 are supplied through appropriate gates 57 with the output pulses corresponding to F4 → F0, F5 → F2, F6 → F0 from gate outputs 52 e, f and g and with output pulses derived elsewhere corresponding to F1 → F0, F3 → F0, F2 → F6 and F0 → F5.

Figure 6:
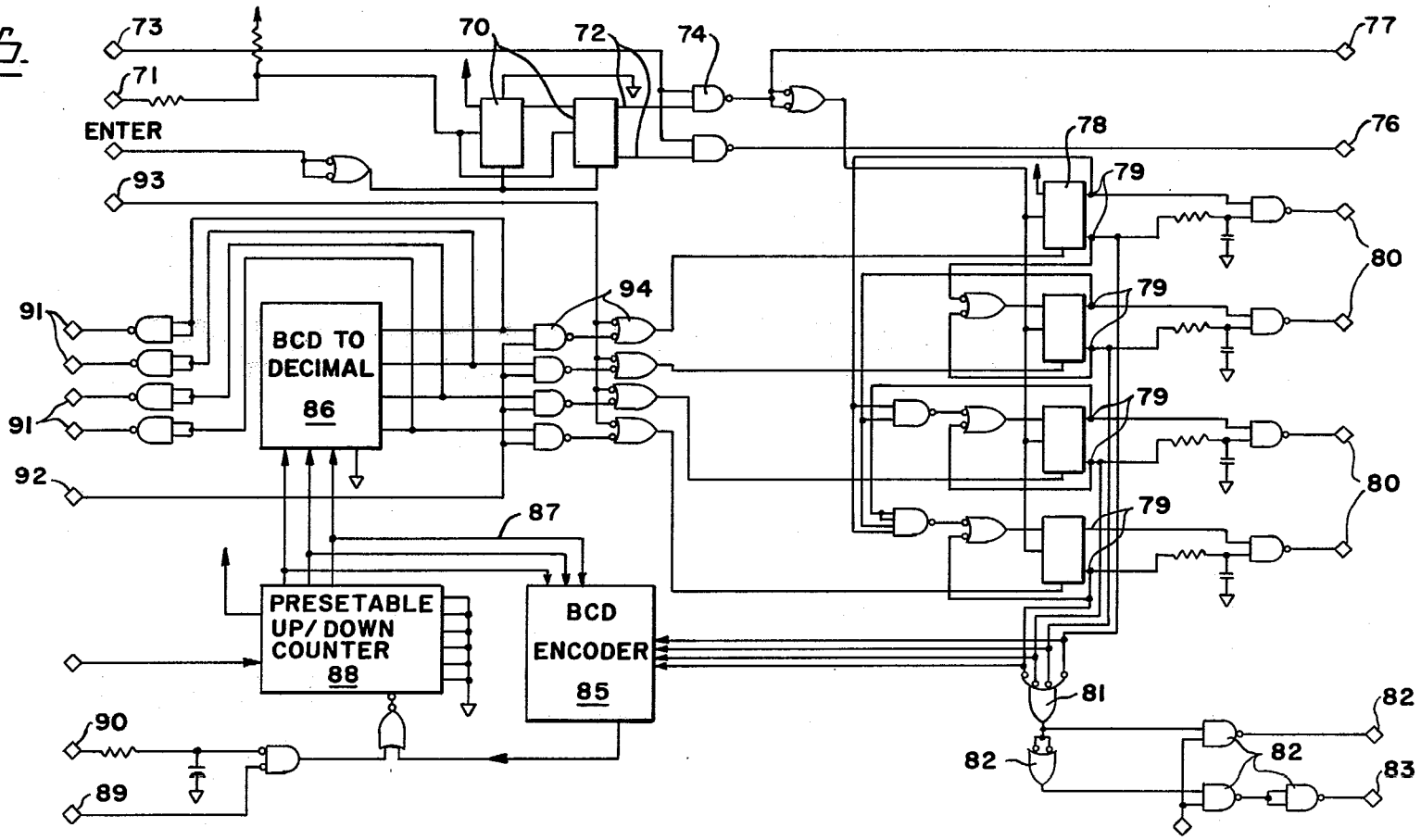
FIG. 6 is a schematic representation of the components of a play control module of FIG. 4.

With reference to FIG. 6, the PLAY CONTROL module 31 comprises latches 70 which are set by a coin pulse appearing at input 71 in the event of a player inserting a coin. The latch outputs 72 are gated with F0 pulses derived from output 52*a* (FIG. 5) and appearing on input 73. The gating 74 produces an output at terminal 76 corresponding to CO or at terminal 77 corresponding to F0 → F5 depending on whether or not a coin has been inserted. The output on gate 74 is also used to set four latches 78 corresponding to four players, the outputs 79 of which latches serve to initialise the individual player enter terminals 80.

The latch outputs 79 are also fed to a gate 81 which derives an output if a player has been entered, i.e. if there is a signal on one of the outputs 79. The output of gate 81 is fed together with F1 pulses derived from output 52b (FIG. 5) to a gating circuit 82 which derives a signal corresponding to C1 on a terminal 82 or a signal corresponding to F1 F0 on a terminal 83 depending on whether or not any players are entered.

The latch outputs 79 are also fed to amultiplexer 85 which is connected to an encoder 86 by binary lines 87 also under the control of an Up/Down Counter 88 which is controlled by a 'still shoot' input 89 and 'INC SHOOTER' input 90 which may be supplied by pulses as described below. Components 85, 86 and 88 thus provide an output 'shoot' signal at one of the four output terminals 91 depending on the latch outputs 79 and the input 89.

An 'END' pulse is fed on to terminal 92 which is connected together with an 'POWER ON RESET' terminal 93 through appropriate gating 94 to re-set terminals of latches 70 to re-set these latches at the end of a game or at the start of a game.

Figure 7:
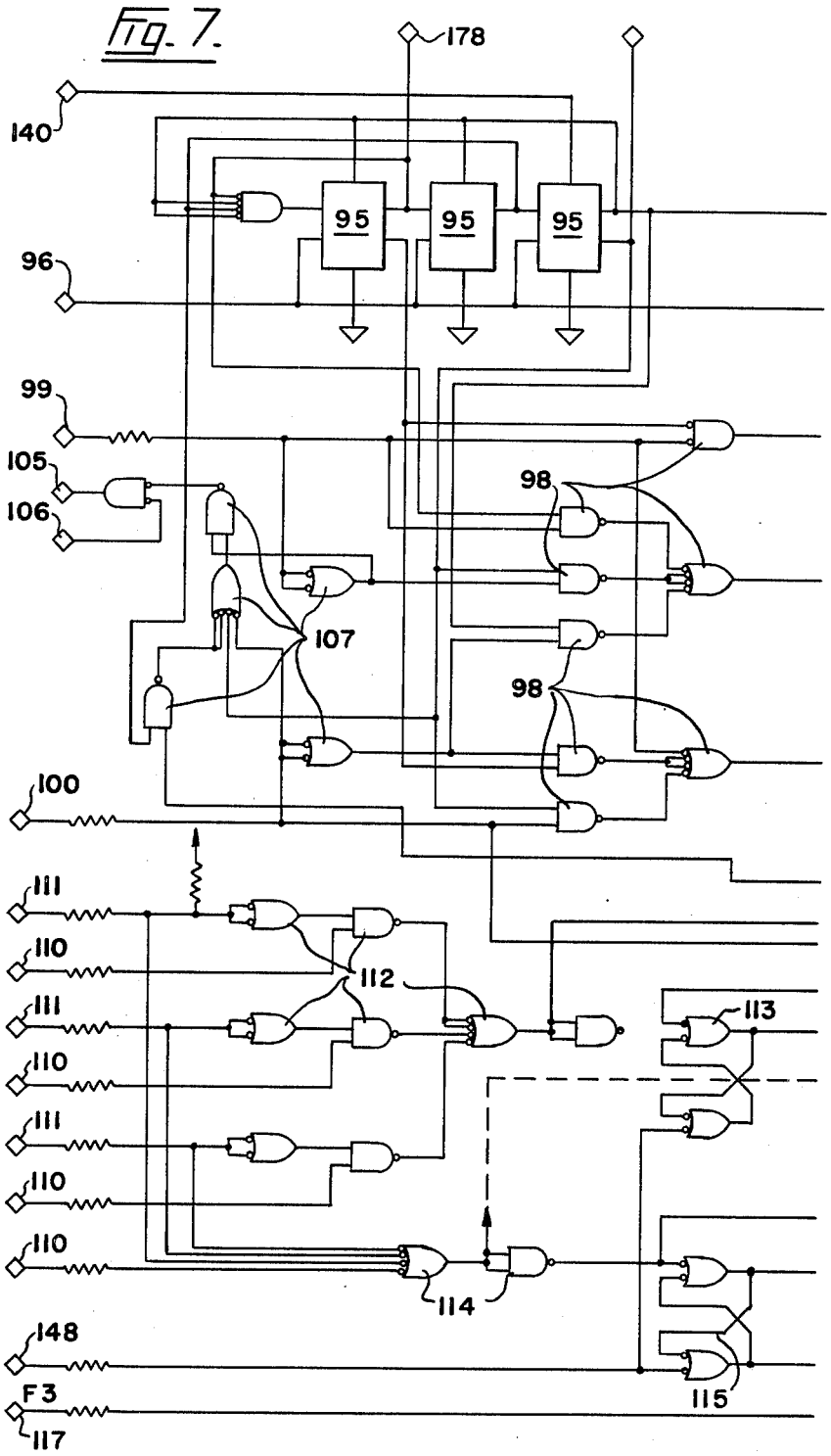
FIGS. 7 and 7 (cont'd) are a schematic representation of the components of a score control module of FIG. 4
Figure 7:
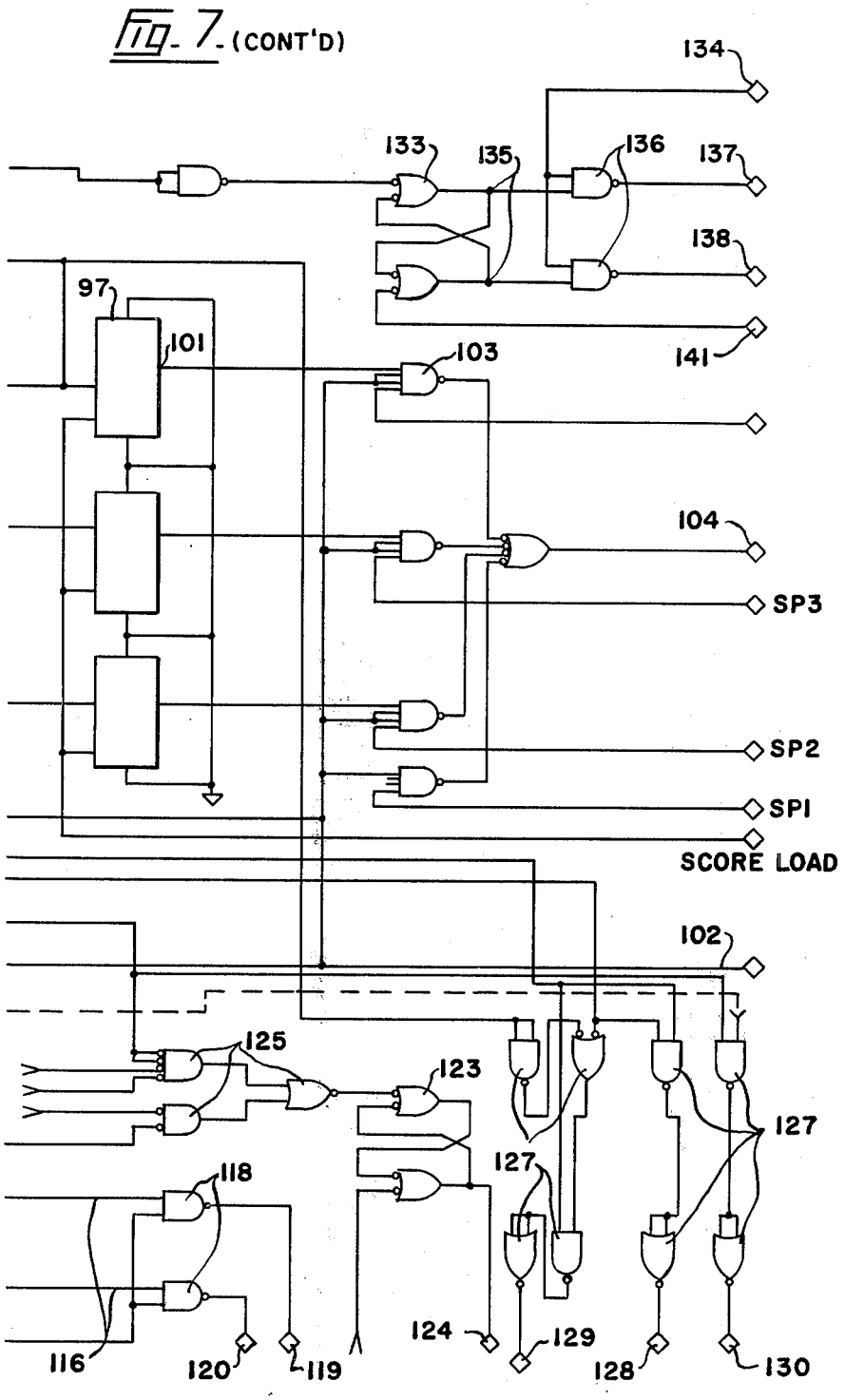

With reference now to FIG. 7, three 'ball' latches 95 are provided which have inputs connected to a terminal 96 which is connected to the 'INC BALL' terminal 55*c* of FIG. 5 to step the latches 95 every time a pulse is received, the Q output from the three latches representing, respectively, balls 1, 2 and 3 for a particular hole.

The possible score for a correct putt is latched into latches 97 by means of gate 98 which determine the score weighed according to the ball number and according to information provided by the Status SELECTOR module. This information is whether the hole a player is shooting at is hole 9 and this appears at terminal 99 or whether the hole is a bonus hole and this appears at terminal 100. The outputs 101 of the latches 97 are gated with the SP1-4 pulses from terminals 55 (FIG. 5) and enable from 'RIGHT SINK' line 102 in gates 103 to provide score pulses SP at the terminal 104 which are then used to drive a count down counter associated with the player shooting.

An 'END' pulse is developed on terminal 105 by gates 107 which have inputs from terminals 99, 100, 106 (the 'END STROBE' of terminal 55k FIG. 5) and from the latches 55 according to the information sensed.

On terminals 110 are supplied pulses according to which hole a player has to shoot for as determined by the STATUS SELECTOR. Terminals 111 bear signals according to which hole a ball has actually been sunk. Gating 112 sets a 'CORRECT SINK' latch 113 which provides an output signal on 'SINK' line 102 if a ball has been sunk in the assigned hole.

The terminals 111 are interconnected through gates 114 to set a latch 115 the outputs 116 of which are gated with a terminal 117 in gates 118. Terminal 117 is connected to terminal 52d of the FUNCTION CONTROL module (FIG. 5) which provides an F3 pulse to derive a pulse on terminal 119 corresponding to function C3 if a ball has been sunk or a pulse on terminal 120 corresponding to function F3 → F6 if a ball has not been sunk.

A 'STILL SHOOT' latch 123 provides an output at terminal 124 according to inputs through gating 125 which looks at whether the correct ball was sunk, the number of the ball and whether the hole was a bonus hole.

Gates 127 derive an output at terminals 128, 129 or 130 according to whether an ordinary hole has been correctly sunk, a bonus hole has been correctly sunk, or a designated hole has been missed thus deriving a specific sound in the noise making device.

Figure 3:
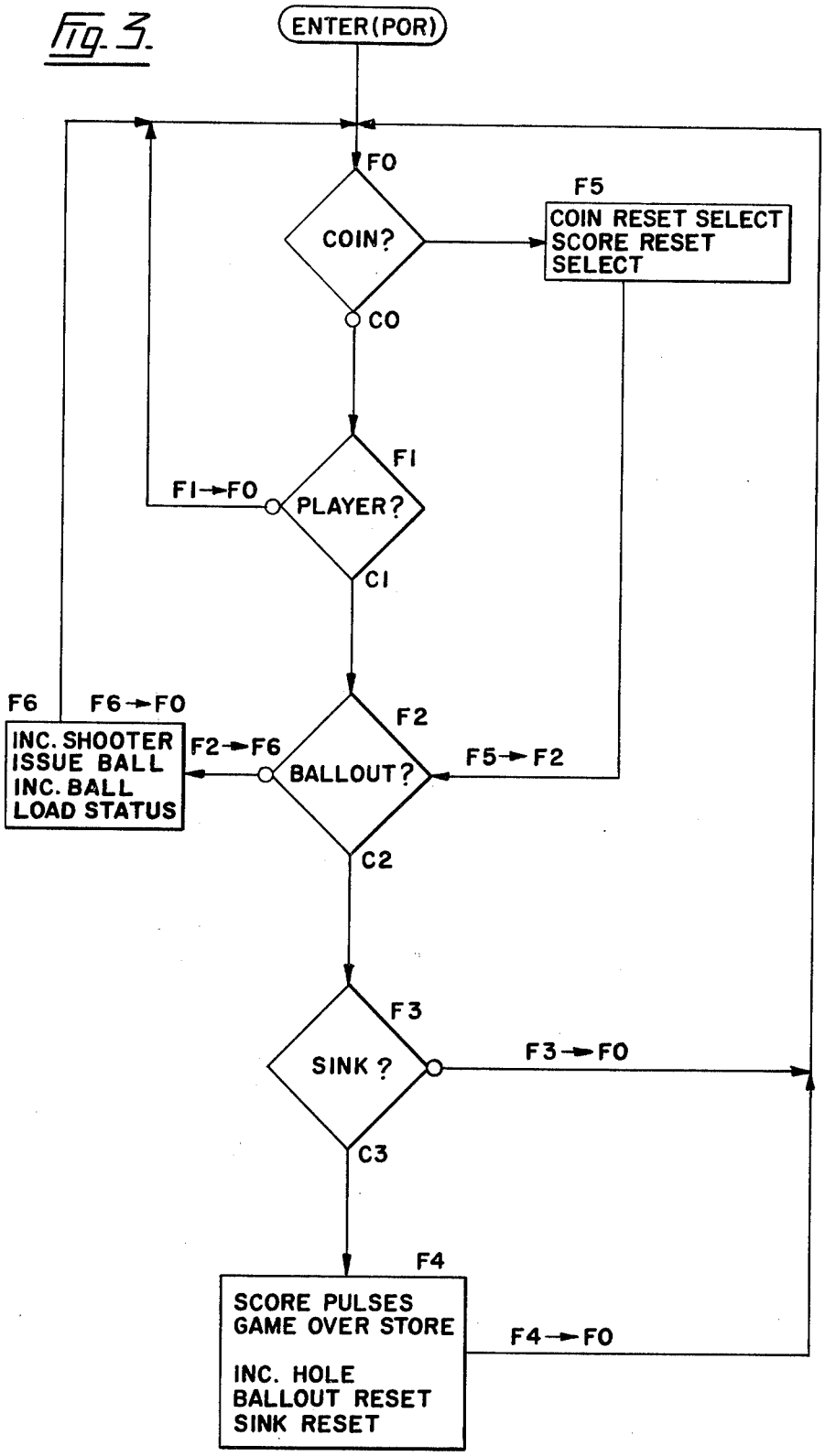
FIG. 3 is a flow diagram showing the functions performed by the logic circuitry of the golf game.

As indicated above in relation to FIG. 3, before the F3 pulse can be delivered the F2 pulse to determine whether a ball has been issued and incremented has to be delivered. This is done by connecting the terminal 96 to a latch 133 and passing an F2 pulse from terminal 55*c* of the FUNCTION CONTROL (FIG. 5) through a terminal 134. The latch outputs 135 and the terminal 134 are connected through gates 136 to terminals 137 and 138 the former deriving a pulse corresponding to C2 when a ball has been issued and incremented and the latter deriving a pulse corresponding to F2 F6 when this is not so.

Terminal 140 is connected to the reset inputs of latches 95 and is connected to terminal 55*a* of FUNCTION CONTROL module (FIG. 5) for resetting the latches 95 when a hole is incremented.

Finally, terminals 141 and 142 are both connected to terminal 551 for resetting the latches 133, 115 and 113.

Figure 8:
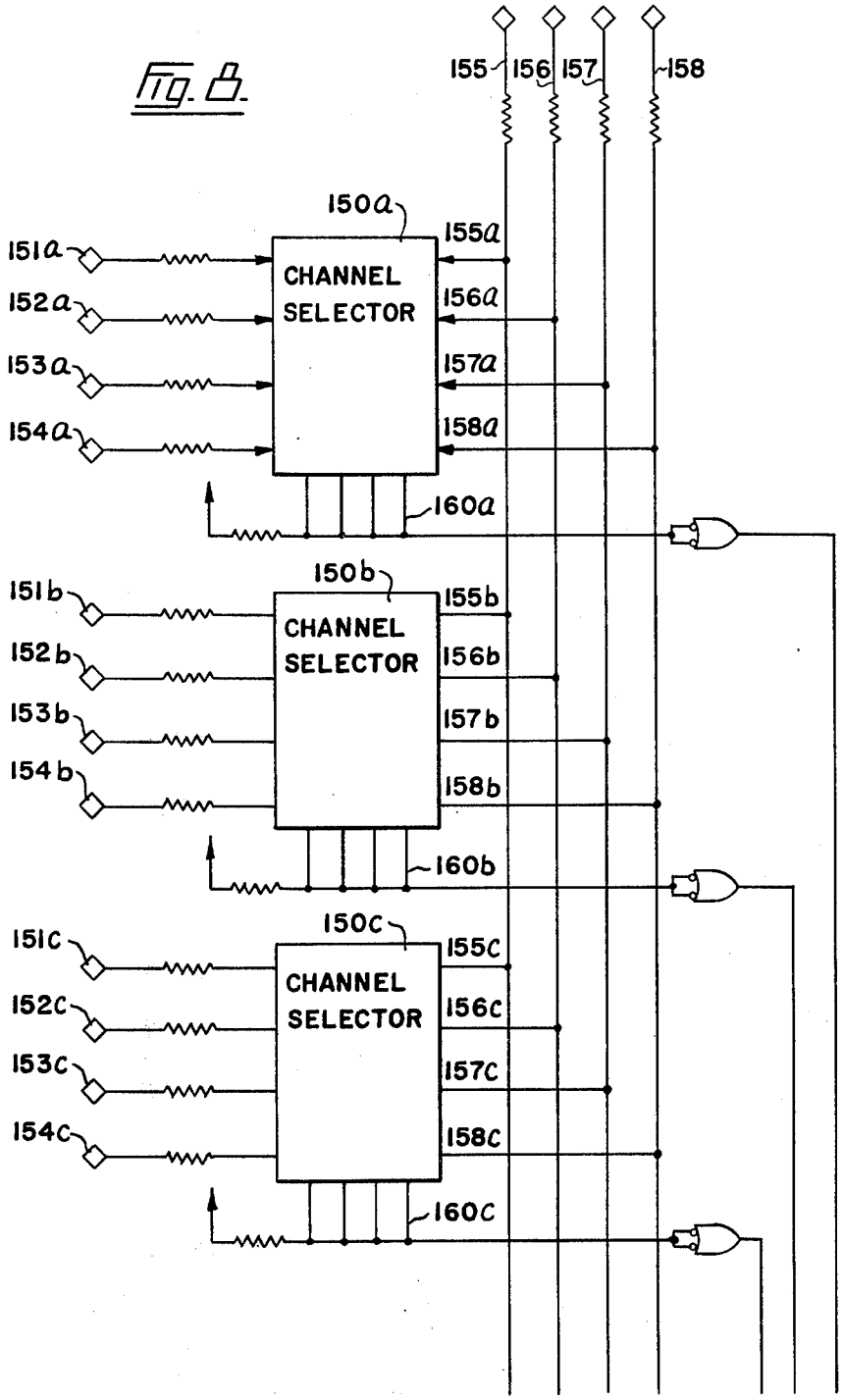
FIGS. 8 and 9 (cont'd) are a schematic representation of the components of a status selector module of FIG. 4.
Figure 8:
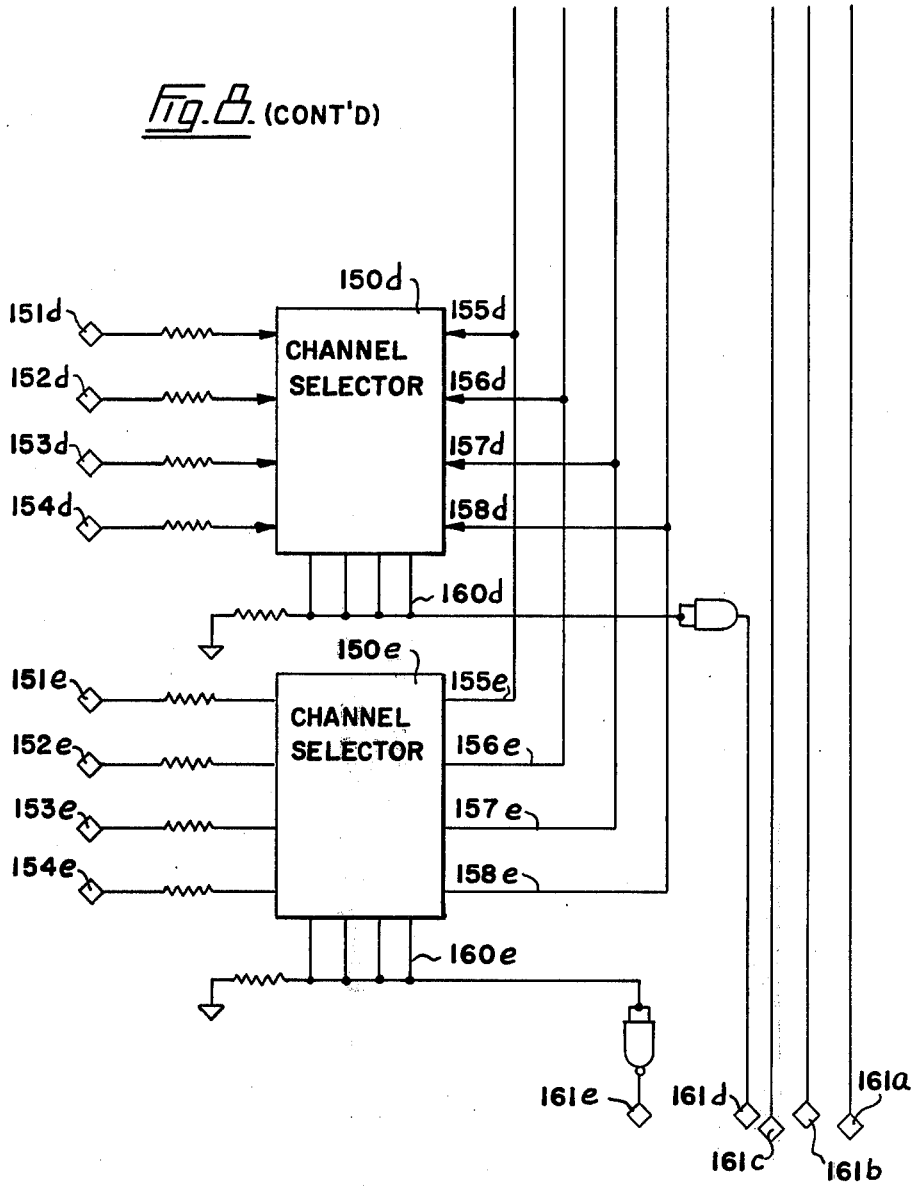

With reference to FIG. 8, the STATUS SELECTOR 34 is shown in greater detail and includes five channel selectors 150*a*–150*e*. Each selector has four inputs 151, 152, 153 and 154 derived from the four Individual Score and Hole modules 33. The inputs 151*a*–154*a* represent one of the three scoring holes derived from the four different Individual modules 33. The inputs 151*b*–154*b* represent a second of the three scoring holes, the inputs 151*c*–154*c* represent the third of the scoring holes, the inputs 151*d*–154*d* carry information indicating that the ninth hole has been reached by a player as derived from his Individual module 33, and the inputs 151*e*–154*e* indicate that a player has earned a bonus hole. Each selector 150 also has control inputs 155, 156, 157 and 158 which may be supplied from terminals 91 of FIG. 6 to indicate which player is shooting. According to which player is shooting information appears on one of the outputs 160 of the channel selectors 150 thus deriving an appropriate signal or signals at outputs 161*a*–*e*. Outputs 161*a*–*c* are connected to terminals 110 of the Score Control (FIG. 7), output 161*d* is connected to terminal 99 of the SCORE CONTROL module and output 161*e* is connected to terminal 100 of the SCORE CONTROL module. The outputs 161*a*–*c* and *e* can also be used to energize through suitable driving circuits the hole lamps and the bonus lamps.

Figure 9:
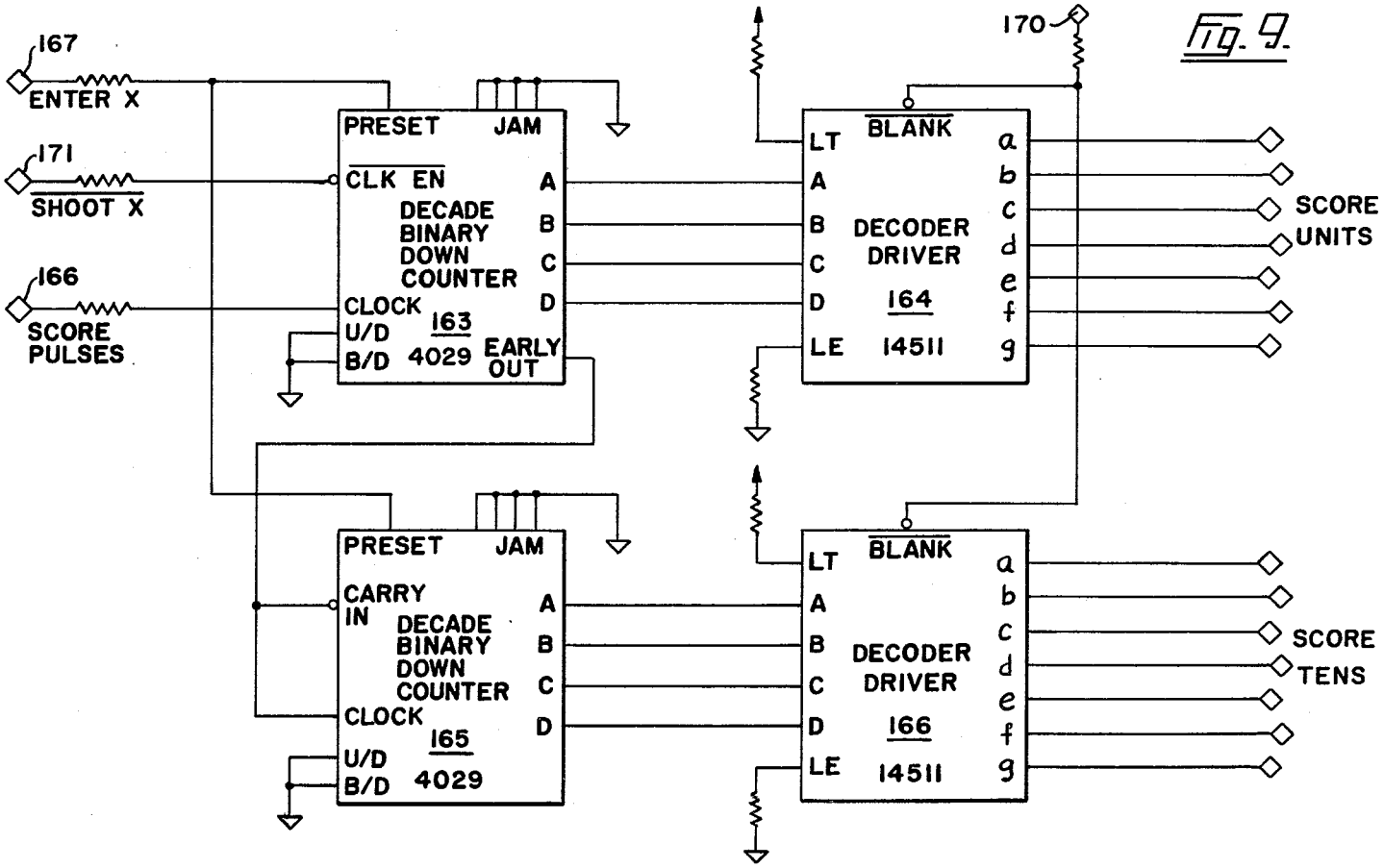

FIG. 9 shows the score portion of an INDIVIDUAL SCORE and HOLE module 33. This comprises a decade binary down counter 163 feeding a decoder/-driver 164 which drives a seven segment units score display (not shown), and a decade binary down counter 165 feeding a decoder/driver 166 which drives a seven segment tens score display (not shown). A terminal 167 connected to the presets of counter 163 and 165 may be connected to one of the terminals 80 of the PLAY CONTROL module (FIG. 6) for presetting the counter to zero (i.e.100) when a player is entered. The counters are decremented from 100 by score pulses appearing on line 166 which is connected to terminal 104 of the SCORE CONTROL module (FIG. 7). A flashing output is received at terminal 170 when the particular player is shooting as determined by input 171 which is connected to one of the terminals 91 of the PLAY CONTROL (FIG. 6).

Figure 10:
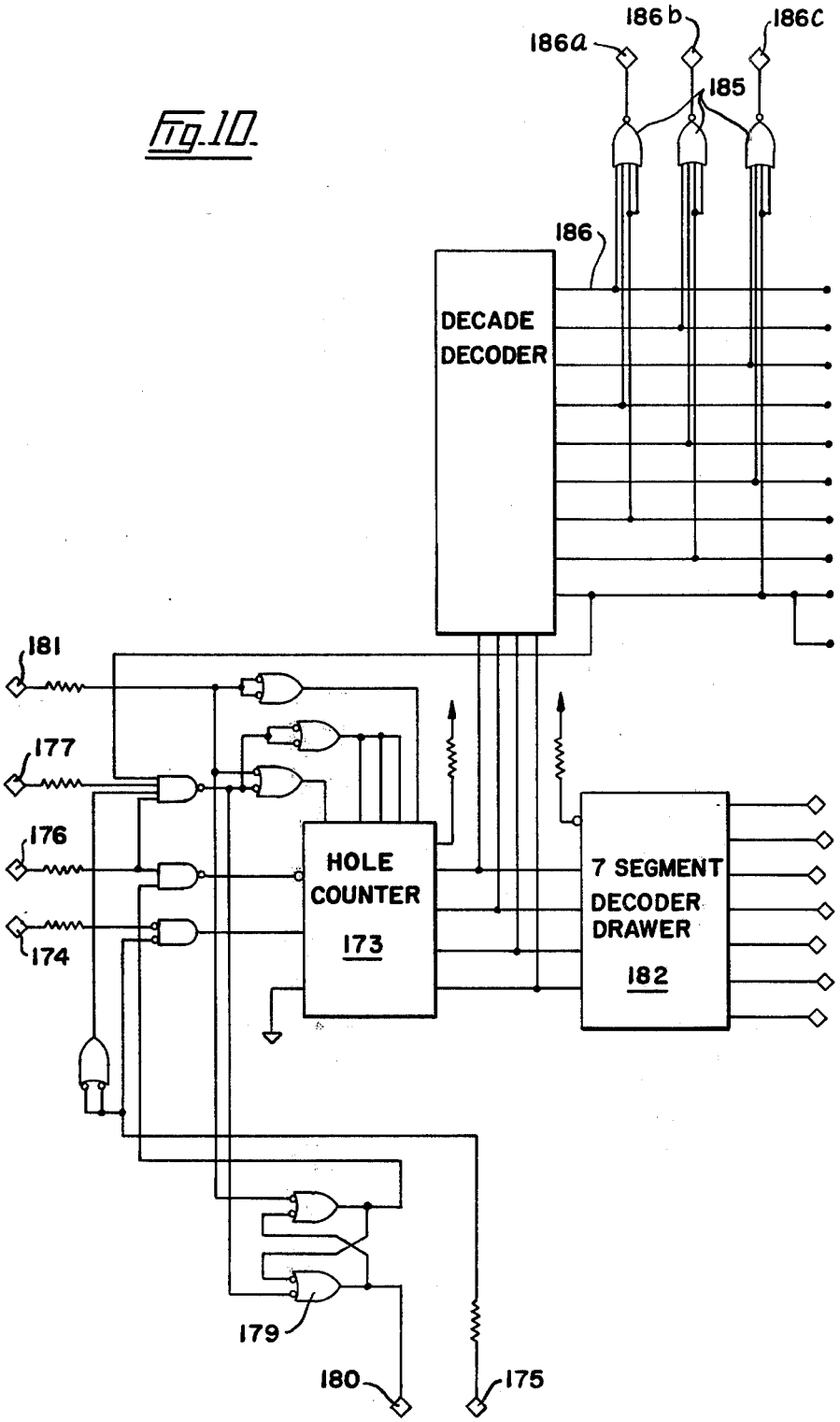
FIG. 10 is a schematic representation of the components of an individual hole module of FIG. 4.

FIG. 10 shows the hole portion of an INDIVIDUAL SCORE and HOLE module 33. This includes a hole counter 173 which is incremented according to the signals appearing on gated inputs 174 and 175. Input 174 is connected through suitable gating to terminal 55*k* of the FUNCTION CONTROL (FIG. 5) and input 175 is connected to one of the terminals 91 of the PLAY CONTROL (FIG. 6). Input terminals 176 and 177 which are connected, respectively, to SINK terminal 102 and terminal BALL 1 terminal 178 of the SCORE CONTROL module are used to set a BONUS latch 179 thus deriving an appropriate signal on terminal 180 which is connected to one of the inputs 151*e*–154*e* of the STATUS SELECTOR (FIG. 8).

The hole counter 173 can be preset to zero by a gated signal appearing on terminal 181 which is connected to an appropriate terminal 80 of the PLAY CONTROL (FIG. 6).

The outputs of the hole counter 173 are fed to a 7 segment decoder/driver 182 which powers the individual hole digit indicator (not shown). The outputs of the hole counter 173 are also fed to a decade decoder 183 which provides an output signal at one of nine outputs 184. As there are only three physical scoring holes these are used three times each. Thus, the outputs 184 are grouped in threes and fed through gates 185 to derive signals on terminals 186*a*, *b*, *c*. These are connected, respectively, to one of the terminals 151*a*–154*a* one of the terminals 151*b*–154*b*, and to one of the terminals 151*c*–154*c* of the STATUS SELECTOR (FIG. 8).

The outputs 184 are also diode-ored (not shown) with the same outputs from the other three INDIVIDUAL HOLE modules to control the indicator in the nine hole course display portion of the display and scoreboard 20. The last output 184, indicated as 184*i* is connected to one of the terminals 151*d*–154*d* of the STATUS SELECTOR (FIG. 8).

I claim:

1. A golf game comprising a playing board, an upper surface of the playing board simulating part of a golf course and having a scoring hole therein promixate an end of the playing board and at least one non-scoring hole therein representing a hazard, a golf ball issuing device, switch means associated with each hole to detect capture therein of a golf ball, a score-board, logic circuit means including means causing operation of the golf ball issuing device to re-issue a golf ball on detection of a golf ball by one of the switch means and means to assign an initial score to the scoreboard, ball count means counting the balls issued, means assigning a number to the scoring hole and incrementing the assigned number on detection of a ball in the scoring hole, and score means decrementing said initial score by predetermined values which vary inversely according to a number of issued balls counted for an assigned hole.

2. A glof game according to claim 1, in which the logic circuit means includes means incrementing the assigned number of the scoring hole after a predetermined number of issued balls counted for the assigned hole.

3. A golf game according to claim 1, in which the playing board is elongate and the playing surface slopes upwardly from both longitudinal end portions to a relatively higher intermediate portion, the holes being located at one end portion and a shooting area being designated at the other end portion for receiving a golf ball.

4. A golf game comprising a playing board, an upper surface of the playing board simulating part of a golf course, the upper surface having at least two spaced scoring holes therein proximate an end of the playing board and the upper surface having at least one non-scoring hole therein representing a hazard, a golf ball issuing device, switch means associated with each hole to detect capture therein of a golf ball, a scoreboard, logic circuit means including means causing operation of the golf ball issuing device to re-issue a golf ball on detection of a golf ball by one of the switch means and means to assign an initial score to the scoreboard, ball count means counting the balls issued, means designating one of the scoring holes and changing designation to another scoring hole on detection of a ball in the designated scoring hole, means assigning a number to the designated scoring hole and incrementing the assigned number on detection of a ball in the designated scoring hole, and score means decrementing said initial score by predetermined values which vary inversely according to the number of issued balls counted for an assigned hole.

5. A golf game according to claim 4, in which the logic circuit means includes means changing designation to another scoring hole after a predetermined number of issued balls counted for an assigned hole, and means incrementing the assigned number of the scoring hole after a predetermined number of issued balls counted for an assigned hole.

6. A golf game according to claim 4, in which the playing board is elongate and the playing surface slopes upwardly from both longitudinal end portions to a relatively higher intermediate portion, the holes being treated at one end portion and a shooting area being designated at the other end portion.

7. A golf game according to claim 4 in which the means assigning a number to the scoring hole increments the assigned number to a predetermined value and in which the logic circuit means including means de-activating the ball issuing means on detection of a ball in the designated hole which has been assigned the predetermined value.

8. A golf game according to claim 7 in which the de-activating means de-activates the ball issuing means after a predetermined number of issued balls counted for the assigned hole of the predetermined value.

9. A golf game according to claim 8, in which the logic circuit means includes means causing operation of the ball issuing device on detection of a ball in the designated hole which has been assigned the predetermined value provided that the predetermined number of issued balls counted for the assigned hole has not been reached.

10. A golf game according to claim 4, in which the logic circuit means includes means for entering a plurality of players, means for storing the individual score, means for storing the individual status of the assigned hole, means for storing the individual status of the designated hole number for each player, and means for designating a player to play.

11. A golf game according to claim 10, in which the means for designating a player operates sequentially in response to detection of a ball in the designated scoring hole.

12. A golf game according to claim 11, in which the means for designating a player operates sequentially in response to a predetermined number of issued balls for an assigned hole.

13. A golf game according to claim 6, in which a foot mat is provided at the designated shooting area.

14. A golf game according to claim 6 in which a gutter is provided along the longitudinal end proximate the holes, the gutter representing an additional hazard.

15. A golf game according to claim 4, in which there are three scoring holes spaced laterally across the playing surface and the score means is arranged to decrement to a value of 72 when the number of balls counted for each assigned hole is 1.

* * * * *